US005295858A

United States Patent [19]

Kasai et al.

[11] Patent Number: 5,295,858

[45] Date of Patent: Mar. 22, 1994

[54] CONNECTING BOX FOR FORMING BRANCH CIRCUIT

[75] Inventors: Kouji Kasai; Yuuji Saka; Shinshu Kato, all of Yokkaichi, Japan

[73] Assignee: Sumitomo Wiring Systems, Ltd., Yokkaichi, Japan

[21] Appl. No.: 992,470

[22] Filed: Dec. 17, 1992

[30] Foreign Application Priority Data

Dec. 20, 1991 [JP] Japan ..... 3-105531
Apr. 14, 1992 [JP] Japan ..... 4-23747

[51] Int. Cl.[5] ..... H01R 4/24
[52] U.S. Cl. ..... 439/404
[58] Field of Search ..... 439/389–425

[56] References Cited

U.S. PATENT DOCUMENTS 4,429,943 2/1984 Inoue .
5,011,417 4/1991 Matsumoto et al. .
5,015,203 5/1991 Furrow .

OTHER PUBLICATIONS

United Kingdom Search Reports.

*Primary Examiner*—Joseph H. McGlynn
*Attorney, Agent, or Firm*—Sandler Greenblum & Bernstein

[57] ABSTRACT

A connecting box for forming branch circuit comprises two rectangular casing members in the same configuration and a plurality of conductive members. Each casing member comprises a partitioning, a plurality of connector-connecting openings disposed on one side thereof with respect to the partitioning wall, a conductive member-accommodating portion disposed on the other side and a plurality of connection portion-inserting openings formed on the partitioning wall. The two casing members are connected with each other with one of the casing members to constitute a case having the conductive member-accommodating portion in the center portion thereof and the connector-connecting openings on the front and back sides. The conductive members are disposed in the conductive member-accommodating portion so as to project a connecting portion of each conductive member into each of the connector-connecting openings formed on the front and back sides of the case through each connection portion-inserting opening.

6 Claims, 9 Drawing Sheets

CONNECTING BOX FOR FORMING BRANCH CIRCUIT

BACKGROUND OF THE INVENTION

1. Field of the Invention

The present invention relates to a connecting box for connecting connectors disposed at the end of a wire harness so as to branch the circuit.

2. Description of the Related Arts

The connecting box, for forming branch circuit, is used to connect the end of the wire harness with various electric devices by branching the circuit thereof so as to locate branching positions at one position to accomplish a reasonable and economical branch connection of the wiring. With very dense wiring in the wire harness, various types of connecting boxes have been developed. Normally, a plurality of connecting circuits are provided inside the casing of the connecting box and connecting openings for connecting connectors disposed at the ends of the wire harness are formed on an end face of the casing.

Various types of connecting circuits including the bus bar method have been proposed to form a highly dense circuit. According to a first example, a connecting circuit includes a plurality of bus bars formed in a maze configuration and pins disposed at the ends of the bus bars standing erect from the surface of the connecting circuit so as to connect connectors with the pins. According to a second example, a plurality of bus bars are provided in parallel with each other in a casing so as to be connected with each other at appropriate intervals by connecting terminals connected with connectors.

In the first example, however, the configurations of the connectors are varied because pins are placed at various positions. If the pins are so placed that the connectors in the same configuration can be used, there is a possibility that the connectors will be inserted into connecting openings erroneously. Thus, it is inevitable to use connectors in various configurations.

In the second example, the connectors and the bus bars are connected with each other in a complicated manner. Thus, it is impossible to connect a connector with a plurality of the same circuits and hence a highly dense and compact connecting circuit cannot be constructed.

Further, in the second example, in order to constitute the casing of a connecting box for, an upper casing and a lower casing are connected with each other by engagement between locking portions of the upper and lower casings, with bus bars interposed between the upper and lower casings.

However, the configuration of the upper casing and that of the lower casing are different from each other. Thus, it is necessary to prepare a mold for the upper casing and a mold for the lower casing, which leads to a high manufacturing cost. In addition, it is necessary to check whether the connecting box is an upward or downward facing connecting box.

SUMMARY OF THE INVENTION

It is an object of the present invention to provide a connecting box for forming branch circuit, with which a plurality of connectors of the same configuration can be connected.

It is another object of the present invention to provide a connecting box for forming a branch circuit, providing connecting circuits of the same construction irrespective of whether each connector is inserted into any connecting opening, so as to prevent connectors from being erroneously connected with connecting openings.

It is still another object of the present invention to provide a connecting box for forming a branch circuit, in which an upper casing and a lower casing can be shaped by the same mold.

It is a further object of the present invention to provide a connecting box for forming a branch circuit, which can be installed on a car body without checking whether the connecting box is upward or downward or whether it is necessary to turn it 180° horizontally.

In accomplishing these and other objects, there is provided a connecting box, for forming a branch circuit, comprising two rectangular casing members. Each casing member comprises: a partitioning wall formed therein; a plurality of connector-connecting openings, in the same configuration, disposed on one side thereof with respect to the partitioning wall; a conductive member-accommodating portion disposed on the other side thereof with respect to the partitioning wall; and a plurality of connection portion-inserting openings formed on the partitioning wall. The two casing members are connected with each other with one of the casing members to constitute a case having the conductive member-accommodating portion in the center portion thereof and the connector-connecting openings on the front and back sides thereof. A plurality of conductive members are disposed in the conductive member-accommodating portion so as to project a connecting portion of each conductive member into each of the connector-connecting openings formed on the front and back sides of the case through each connection portion-inserting opening.

The conductive member disposed in the conductive member-accommodating portion comprises a plurality of terminals and a plurality of single core wires. Each terminal comprises a blade which penetrates into the single core wire in a direction perpendicular to the axial direction of the single core wire and is brought into contact with the single core wire and a connecting portion extending from the blade symmetrically in a direction perpendicular to the axial direction of the single core wire. The connecting portion projects into each of the connector-connecting openings formed on the front and back sides of the case through each of the connection portion-inserting openings formed on both partitioning walls. The single core wires are arranged in parallel with each other in the conductive member-accommodating portion so as to bring a plurality of terminals having connecting portions projecting into different connector-connecting openings into contact with one of the single core wires. The conductive member is constituted in this manner.

The terminal has four poles, each including a contact strip formed by extending the connecting portions symmetrically in vertical and horizontal directions with respect to the blade. That is, two contact strips, functioning as poles, project into the connector-connecting openings formed in the front side of the case and the back side thereof, respectively.

The conductive member disposed in the conductive member-accommodating portion includes a vertical bus bar, in which tabs project at regular intervals from both sides of a center base plate of the vertical bus bar into the connector-connecting openings formed on the front and back sides of the case through the connecting portion-inserting openings formed on both sides of the case.

The connector-connecting openings are formed on one side of the casing member symmetrically in horizontal and vertical directions. The connection portion-inserting openings are formed on the partitioning wall symmetrically in horizontal and vertical directions. A male locking portion and a female locking portion are formed on one end face of the casing member. Another male locking portion is formed on the other end face thereof opposed to the one end face, such that both male locking portions are symmetrical with respect to the center point of the casing member. Similarly, another female locking portion is formed on the other end face thereof opposed to the one end face, such that both female locking portions are symmetrical with respect to the center point of the casing member. One casing member is turned 180° vertically with respect to the other casing member, so that the male locking portions of the other casing member are locked by each female locking portion of one casing member and the male locking portions of one casing member are locked by each female locking portion of the other casing member. As a result, both connecting members are connected with each other. The vertical bus bar is accommodated in the conductive member-accommodating portion formed in the center portion of the case formed by the above-described method.

The mounting portions to be mounted on a car body are formed on end faces of each casing member opposed to each other and perpendicular to the end faces thereof on which the male and female locking portions are formed. The mounting portions on each end face of the case are symmetrical with respect to the center point of each end thereof.

In addition, the female and male locking portions projecting from the end faces opposed to each other, are disposed in the center portion (conductive member-inserting portion) of case formed by connecting the two casing members with each other. That is, the male locking portions are locked by the female locking portions in the center portion of case.

Further, the conductive member-inserting openings are formed in parallel with each other on the partitioning wall composing the bottom wall of the connector-connecting openings. A conductive member-supporting portion projecting from the portion between the conductive member-inserting openings adjacent to each other is formed on the conductive member-inserting side of the partitioning wall. A conductive member guide groove communicating with the conductive member-inserting openings is formed on the conductive member-supporting portion.

Furthermore, the connector-connecting openings are formed vertically in plural stages and two (upper and lower) conductive member-inserting openings are formed horizontally in parallel with each other in each stage. The conductive member disposed in the conductive member-accommodating portion includes a vertical bus bar. That is, a plurality of tabs to be inserted into the conductive member-inserting openings, of one casing member and formed in a vertical line, project at predetermined intervals from one side of a center base plate extending vertically, while a plurality of tabs to be inserted into the conductive member-inserting openings of the other casing member project at predetermined intervals from the other side of the center base plate.

According to the above construction, a plurality of connectors in the same configuration can be connected with the connecting openings formed on the front and back end faces of the case. Regardless of whether connectors are connected with the connecting openings disposed on the front end face of the case or those disposed on the back end face thereof, connecting circuits in the same construction can be obtained because the terminals are symmetrical horizontally and vertically. Therefore, the connector can be prevented from being inserted into an erroneous connecting opening, which prevents an erroneous connection between the connectors and the connecting openings. Further, the case of the connecting box can be assembled by connecting two casing members with each other and the terminal has a symmetrical construction. Thus, it is unnecessary to check whether the case is upward or downward in connecting the two casing members with each other and hence they can be connected with each other easily, which reduces manufacturing cost.

Further, the male locking portions and the female locking portions are at symmetrical positions of both end faces of the casing members opposed to each other. Therefore, when the upper casing member is placed on the lower casing member with the lower casing member turned upside down, the male locking portions of the upper casing member are locked by each female locking portion of the lower casing member, and the male locking portions of the lower casing member are locked by each female locking portion of the upper casing member. In this manner, the upper and lower casings are connected with each other to form the case. Since the upper and lower casings can be shaped in the same die, manufacturing cost can be reduced.

When the upper and lower casings are connected with each other, the mounting portions formed on the end faces of each casing member are symmetrical with respect to the center point of each of the end faces of the case perpendicular to the end faces on which the male and female locking portions are mounted. Therefore, the case can be easily mounted on a car body without checking whether the casing is upward or downward. Thus, the case can be efficiently mounted on the car body.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
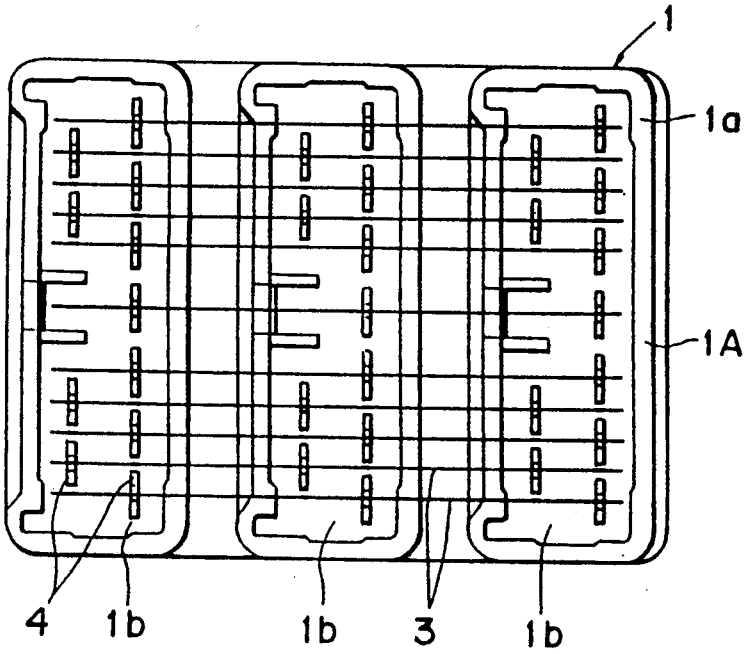
FIG. 1 is a plan view showing a connecting box for forming a branch circuit according to the present invention.

Before the description of the present invention proceeds, it is to be noted that like parts are designated by like reference numerals throughout the accompanying drawings.

Figure 2:
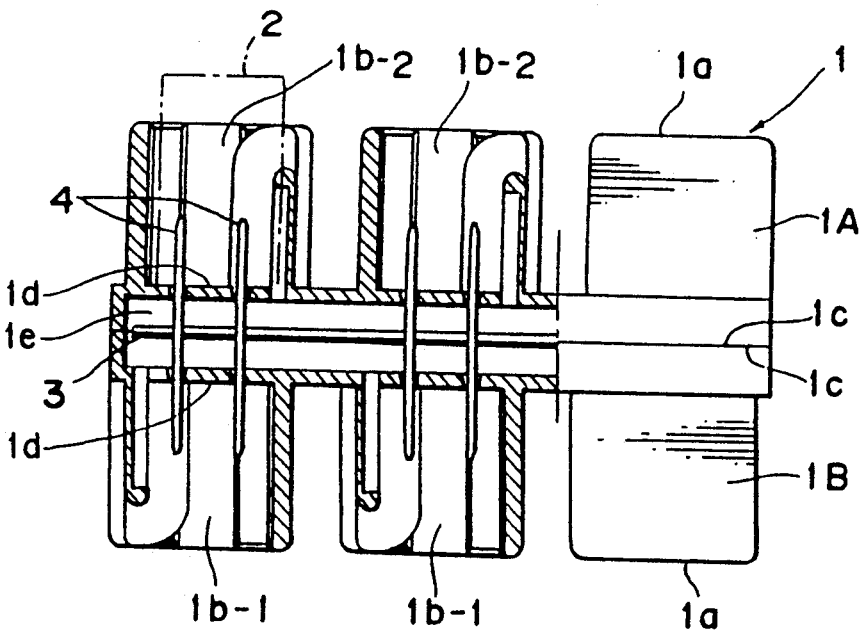
FIG. 2 is a sectional view of a side face of the connecting box of FIG. 1.
Figure 3:
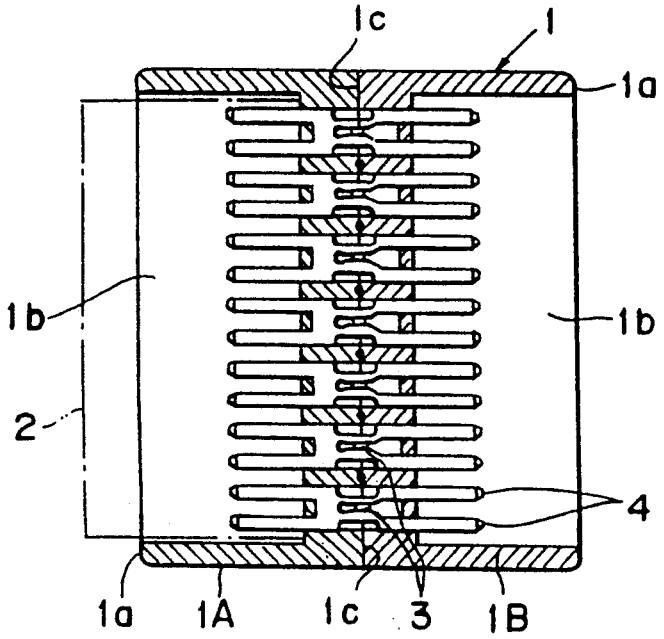
FIG. 3 is a sectional view of a front view of the connecting box of FIG. 1.

A connecting box for forming branch circuit according to a first embodiment will be described below with reference to FIGS. 1 through 3. A case 1 of a connecting box comprises two casing members 1A and 1B, which are formed in the same configulation and are connected with each other. That is, the two casing members 1A and 1B are approximately rectangular and each accommodates a partitioning wall 1*d*. Each of the two casing members 1A and 1B has, on an end face 1*a* of the partitioning wall 1*d* thereof, a plurality of connecting openings 1*b* (three in FIG. 1) into which each of a plurality of connectors 2 (shown by the two-dot chain line in FIG. 2) in the same configuration is inserted. The case 1 is assembled by connecting the other end face 1*c* of the casing the other end face 1*c* of the casing member 1B with each other, with the connecting openings 1*b* disposed on the front and back end faces of the case 1.

Figure 4:
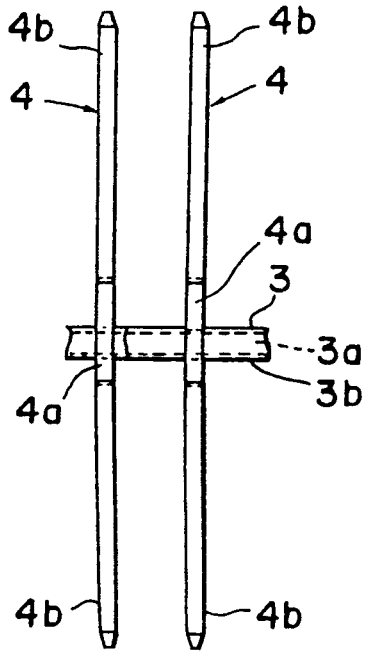
FIG. 4 is a side elevational view showing a terminal.
Figure 5:
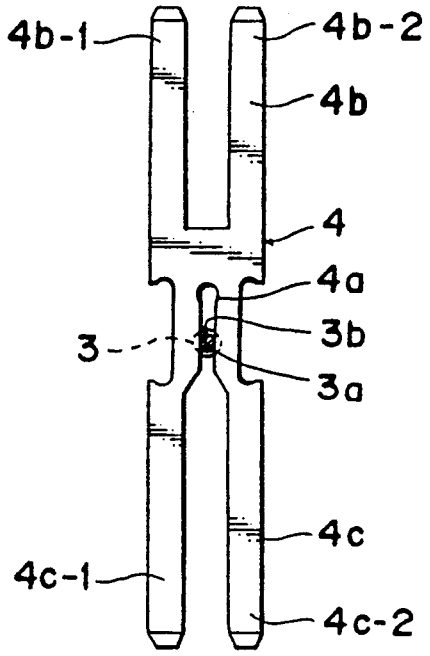
FIG. 5 is a front view of the terminal of FIG. 4.
Figure 6:
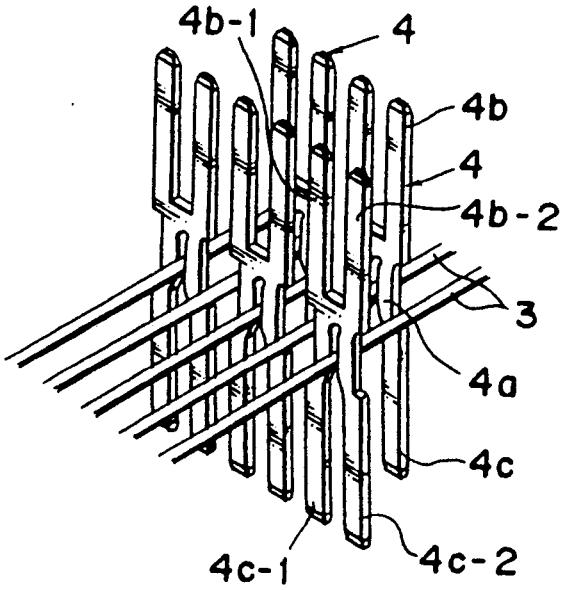
FIG. 6 is a perspective view showing terminals.

A conductive member-accommodating portion 1*e* is interposed between the other end faces 1*c* and 1*c* of each of the casing members 1A and 1B, and a plurality of single core wires 3 (11 wires 3 in FIG. 1) are spaced in parallel with each other at regular intervals in the conductive member-accommodating portion 1*e*. As shown in FIGS. 4 and 5, each single core wire 3 comprises a conductive wire 3*a* and a insulated coating 3*b*.

In correspondence with each connecting opening 1*b*, a plurality of terminals 4 (three in FIG. 1) is installed on each single core wire 3 so that the position of each terminal 4 coincides with that of each terminal of each connector 2.

As shown in detail in FIGS. 4 and 5, each terminal 4 comprises a blade 4*a* including a U-shaped groove, penetrating into the coating 3*b* of the single core wire 3 in a direction perpendicular to the axial direction of the single core wire 3, which is brought into contact with the conductive wire 3*a* and connecting portions 4*b* and 4*c* extending symmetrically upward and downward from the blade 4*a* in a direction perpendicular to the axial direction of the single core wire 3. The connecting portions 4*b* and 4*c* are fork-shaped in the axial direction of the single core wire 3. That is, terminal portions 4*b*-1 and 4*b*-2 of the connecting portion 4*b* and terminal portions 4*c*-1 and 4*c*-2 of the connecting portion 4*c* are symmetrical, respectively in the axial direction of the single core wire 3. That is, each terminal 4 has two poles including terminal portions 4*b*-1 and 4*b*-2 of the connecting portion 4*b* extending upward from the blade 4*a* and two poles including the terminal portions 4*c*-1 and 4*c*-2 of the connecting portion 4*c* extending downward from the blade 4*a*. Therefore, each terminal 4 has four poles.

The terminal portions 4*b*-1 and 4*b*-2 of the terminal 4 are disposed inside connecting opening 1*b*-1 on the front side of the case 1, and the terminal portions 4*c*-1 and 4*c*-2 of the terminal 4 are disposed inside connecting opening 1*b*-2 on the back side of the case 1.

As described above, according to the first embodiment, a plurality of the connecting openings 1*b* in the same configuration are formed on the front and back end faces of the case 1 and therefore, a plurality of connectors 2 in the same configuration can be inserted into the connecting openings 1*b*. In addition, regardless of whether the connectors 2 are connected with the connecting openings 1*b* disposed on the front end face of the case 1 or those disposed on the back end face thereof, connecting circuits in the same construction can be obtained. Therefore, the connector 2 can be prevented from being inserted into an erroneous connecting opening 1.

As described above, the two casing members 1A and 1B, which are in the same configuration, are only connected with each other to form the case 1, which facilitates an automatic assembling operation.

Further, the terminal 4 comprises terminal portions 4*b* and 4*c* extending symmetrically from the blade 4*a* in a direction perpendicular to the axial direction of the single core wire 3 in correspondence with the connecting openings 1*b* formed on the front and back end faces of the case 1. In addition, the terminal portions 4*b* and 4*c* are fork-shaped and hence the terminal 4 has two poles on the front side of the case 1 and two poles on the back side thereof, respectively. Thus, the terminal 4 can be connected with various types of connectors. The terminals 4 are in the same configuration and thus can be easily manufactured by the same die. Therefore, a small number of parts is required to manufacture the terminal 4, which reduces manufacturing cost.

Further, the terminal 4 is symmetrical vertically and horizontally and hence it is unnecessary to check whether the case 1 is upward or downward, which facilitates the automatic assembling operation. In addition, the number of the terminals 4 to be installed on the single core wire 3 can be varied as necessary.

A connecting box for a branching circuit, according to a second embodiment of the present invention, will be described below with reference to FIGS. 7 through 16. According to the second embodiment, a case 10 of the connecting box comprises an upper casing member 20A and a lower casing member 20B connected with each other. It is to be noted that when it is unnecessary to distinguish the casing member 20A and the casing member 20B from each other, both casing members 20A and 20B are denoted by 20.

Figure 11A:
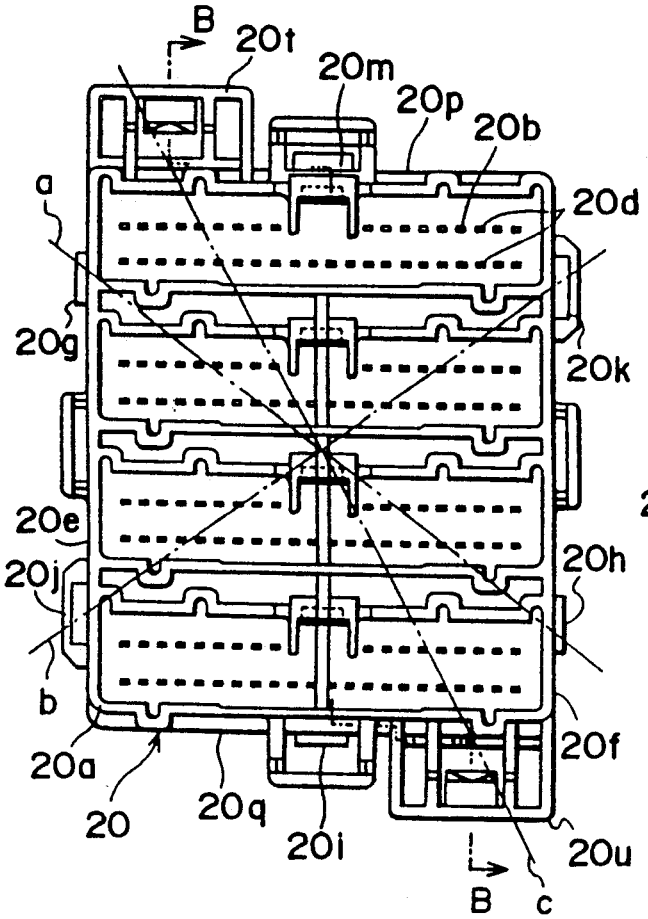
FIG. 11A is a plan view showing a casing member.
Figure 11B:
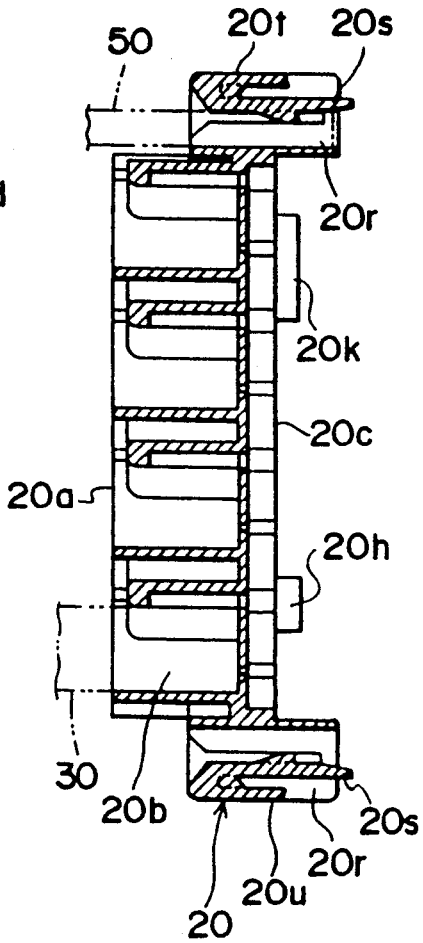
FIG. 11B is a sectional view showing the casing member taken along line B—B of FIG. 11A.
Figure 11C:
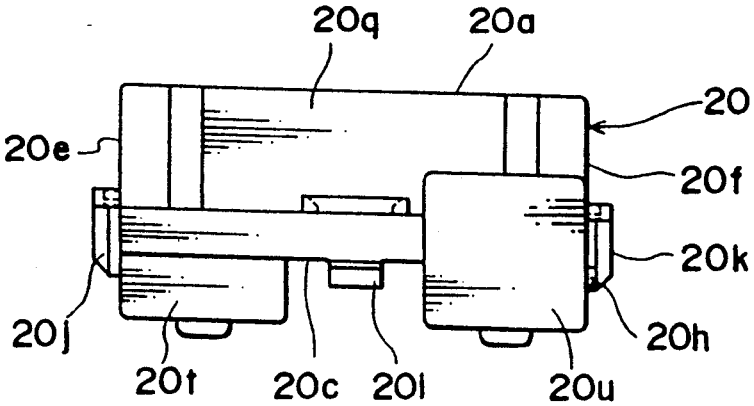
FIG. 11C is a bottom view showing the casing member of FIG. 11A.

That is, as shown in FIGS. 11A–11C, the rectangular casing member 20 has, on an end face 20*a* thereof, a plurality of connecting openings 20*b* (four in FIG. 11B) arranged symmetrically in horizontal and vertical directions. Each of a plurality of connectors 30 (see FIG. 11B) in the same configuration is inserted into each of the connecting openings 20*b*.

Figure 12A:
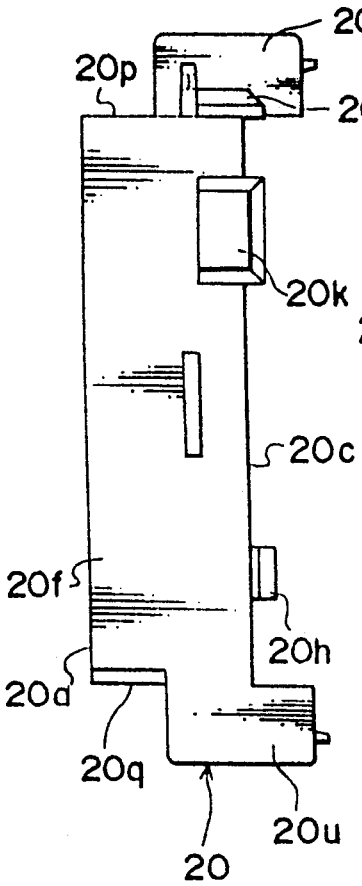
FIG. 12A is a side elevation showing a casing member.
Figure 12B:
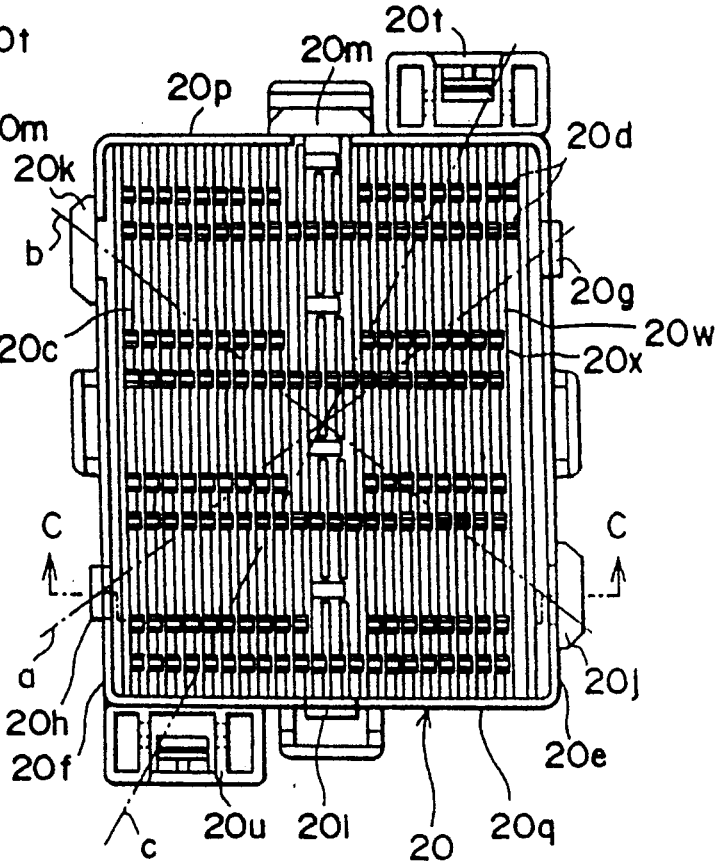
FIG. 12B is a rear view showing the casing member of FIG. 12A.
Figure 12C:
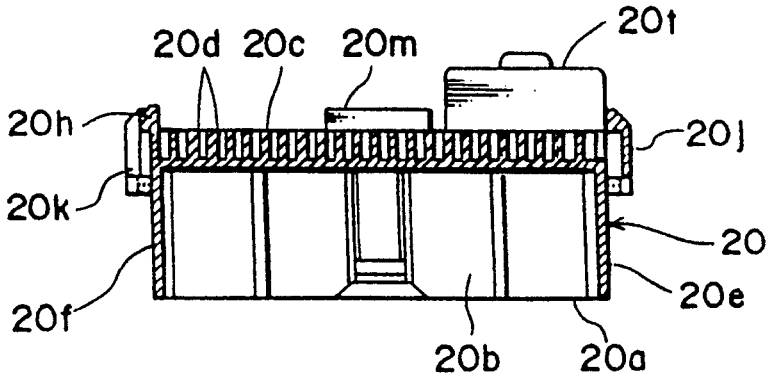
FIG. 12C is a sectional view showing the casing member taken along line C—C of FIG. 12B.

As shown in FIG. 12B, conductive member-inserting openings 20*d* are formed in a plural rows (22 rows in FIG. 12B) on the other partitioning wall 20*c* composing the bottom wall of the connector-connecting openings 20b. Either a tab 40a or a tab 40b of a vertical bus bar 40 (see FIG. 13) is inserted into the conductive member-inserting openings 20d.

Referring to FIG. 12B, a conductive member-supporting portion 20w, including a narrow vertical rib, projecting from each portion between the conductive member-inserting openings 20d and 20d adjacent to each other is formed on the conductive member-inserting side of the partitioning wall 20c. A conductive member guide groove 20x communicating with the conductive member-inserting opening 20d is formed on the conductive member-supporting portion 20w.

Figure 13:
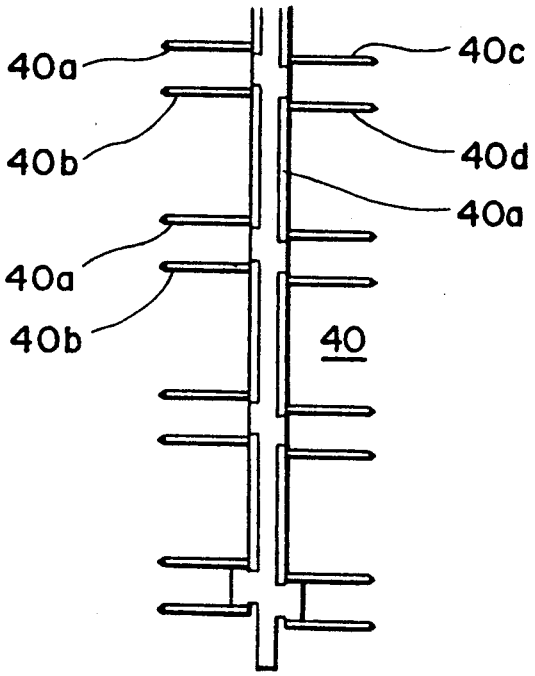
FIG. 13 is a side elevation showing a vertical bus bar.

As shown in FIG. 13, the vertical bus bar 40 comprises a pair of tabs 40a and 40b and a pair of tabs 40c and 40d projecting leftward and rightward, respectively at regular intervals from a center base plate 40e, which extends longitudinally of the casing member 20. The pair of tabs 40a and 40b and the pair of tabs 40c and 40d are inserted into a pair of the conductive member-inserting opening 20d formed on the partitioning wall 20c of the connector-connecting opening 20b of the casings 20A and 20B.

Figure 14:
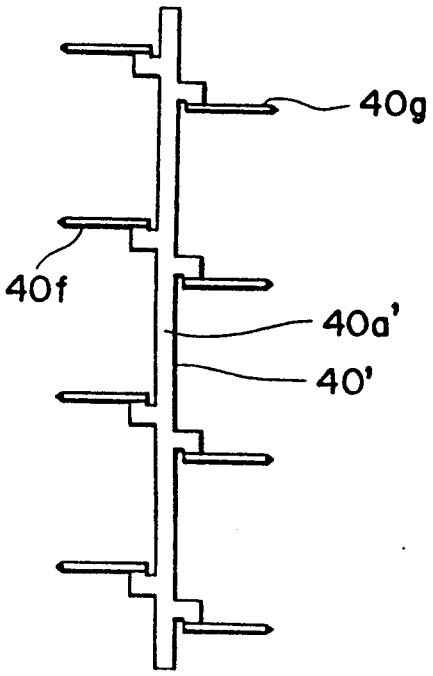
FIG. 14 is a side elevation showing another vertical bus bar.

A vertical bus bar 40', as shown in FIG. 14, has a tab to be inserted into the conductive member-inserting opening 20d formed in the center portion of the casing member 20. In the center portion of the casing member 20, only one conductive member-inserting opening 20d is formed on the partitioning wall 20c of each of the connector-connecting openings 20b arranged in a same vertical line. Thus, unlike the above-described tabs 40a and 40b and the tabs 40c and 40d, only one tab 40f and 40g, spaced at predetermined intervals, project from either side of a center base plate 40a'.

Tabs 40a through 40g of each of the vertical bus bars 40 and 40' projecting from the conductive member-inserting opening 20d into the connector-connecting opening 20b are connected with the connector 30.

As shown in FIGS. 11A–11C and 12A–12C, male locking portions 20g and 20h, flush with the partitioning wall 20c of the casing member 20, having a locking concave female locking portions 20j and 20k, flush with the partitioning wall 20c, and a locking claw being formed on each of end faces 20e and 20f (right and left side end faces in FIG. 11A) opposed to each other. The male locking portions 20g and 20h are symmetrical with respect to the center point P of the casing member 20 and are placed on each end of a diagonal line "a". Similarly, the female locking portions 20j and 20k are symmetrical with respect to the center point P of the casing member 20 and placed on each end of a diagonal line "b".

A female locking portion 20m having a construction similar to that of the female locking portions 20j and 20k is formed in the middle of an end face 20p (upper and lower end face in FIG. 11A) of the casing member 20. Similarly, a male locking portion 20i having a construction similar to that of the male locking portions 20g and 20h is formed in the middle of the other end face 20q opposed to the end face 20p.

There is formed, on the end face 20p, a mounting portion 20t having a cylindrical portion 20r to be inserted into a mounting bracket 50 (see FIG. 11B) installed on a car body. There is formed, on the other end face 20q, a mounting portion 20u having a locking claw 20s for locking the mounting bracket 50 inserted into the cylindrical portion 20r. The mounting portions 20t and 20u are symmetrical with respect to the center point P of the casing member 20 and placed on each end of a diagonal line "c".

Figure 15:
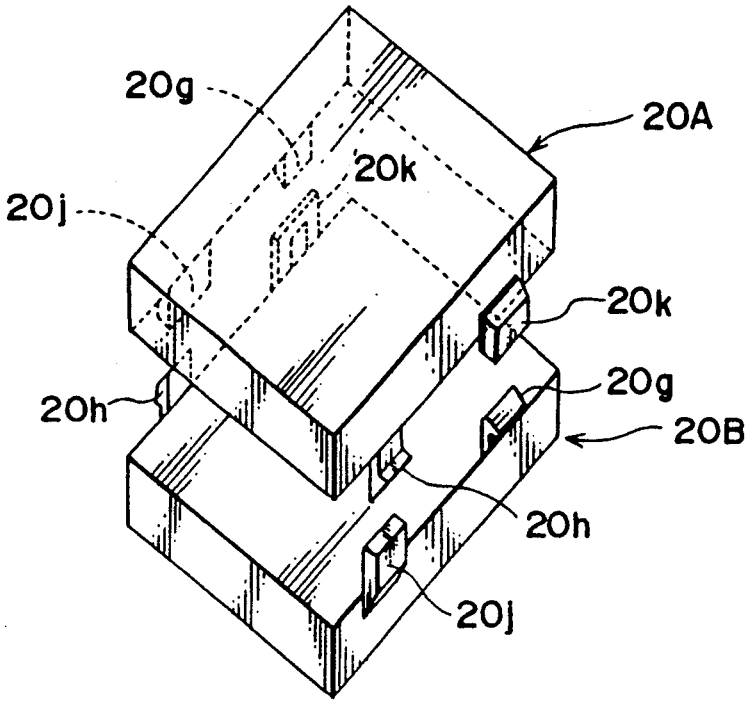
FIG. 15 is a perspective view showing the locking relationship between an upper casing member and a lower casing member.
Figure 16:
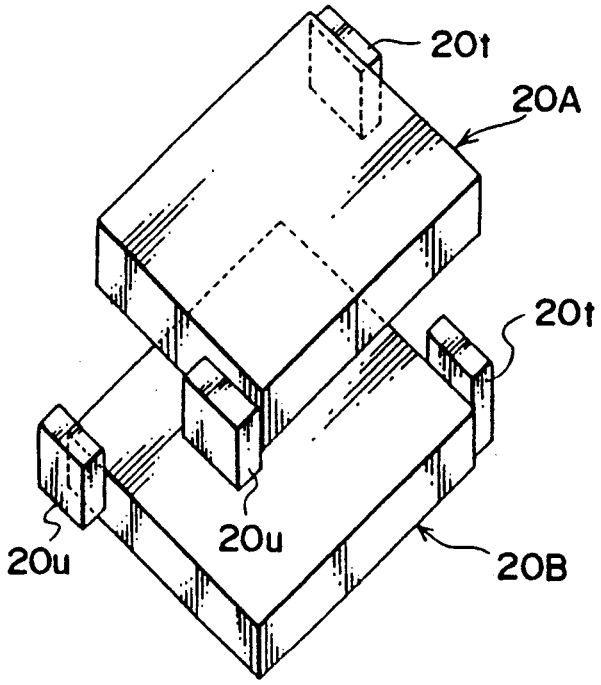
FIG. 16 is a perspective view showing the mounting relationship between the upper casing member and the lower casing member.

Referring to FIGS. 15 and 16, the case 10 is assembled as follows: First (upper) casing member 20A and second (lower) casing member 20B in the same configuration are prepared. The upper casing member 20A is turned 180° vertically lenghtwise or widthwise to obtain the lower casing member 20B. That is, the upward end face 20a of the upper casing member 20A having the connecting opening 20b formed thereon is upward and the upward end face 20a of the lower casing member 20B having the connecting opening 20b formed thereon is downward.

The lower partitioning wall 20c of the upper casing member 20A is placed on the upper partitioning wall 20c of the lower casing member 20B, with the tabs 40a and 40b of the vertical bus bar 40 inserted into the conductive member-inserting openings 20d of the lower partitioning wall 20c of the upper casing member 20A. As a result, the tabs 40c and 40d of the vertical bus bar 40 are inserted into the conductive member-inserting openings 20d of the upper partitioning wall 20c of the lower casing member 20B.

At the same time, the male locking portions 20h and 20g of the upper casing member 20A are locked by the female locking portions 20j and 20k of the lower casing member 20B, respectively and the male locking portions 20h and 20g of the lower casing member 20B are locked by the female locking 20j and 20k of the upper casing member 20A, respectively. Similarly, the male locking portion 20i of the upper casing member 20A is locked by the female locking portion 20m of the lower casing member 20B, and the male locking portion 20i of the lower casing member 20B is locked by the female locking portion 20m of the upper casing member 20A.

Figure 10:
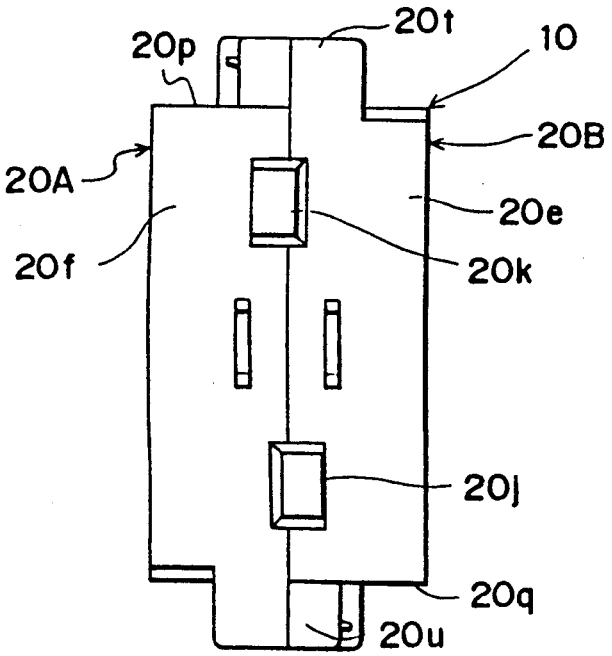
FIG. 10 is a side elevation of the casing of FIG. 7.

The upper casing member 20A and the lower casing member 20B are connected with each other by the locking between the male locking portions 20g, 20h, and 20i and the female locking portions 20j, 20k, and 20m. Thus, the case 10 of the connecting box for branching a circuit is assembled as shown in FIG. 10.

Figure 7:
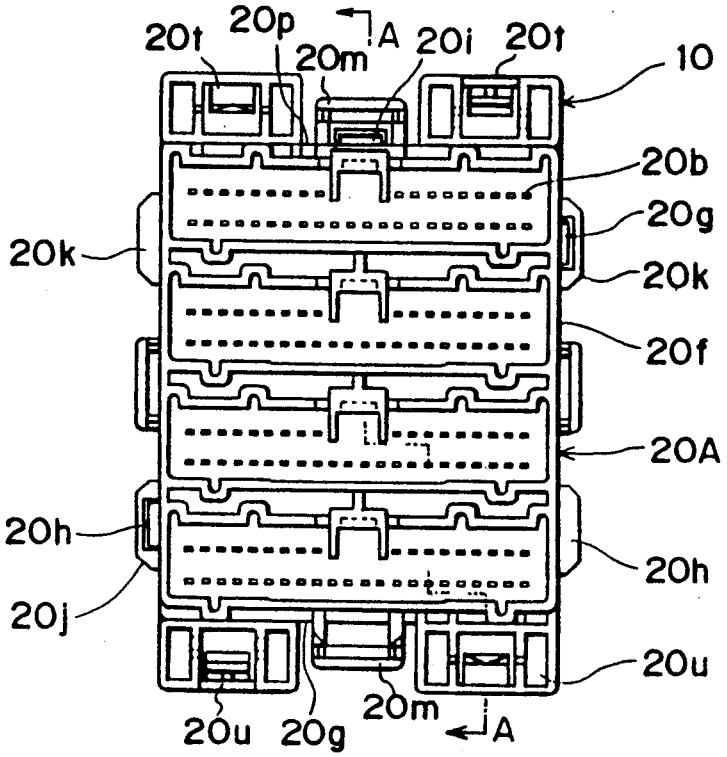
FIG. 7 is a plan view showing a casing.
Figure 8:
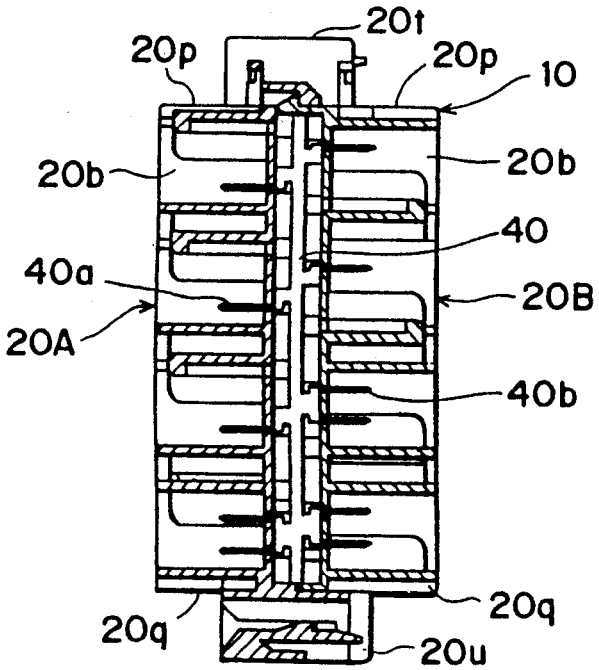
FIG. 8 is a sectional view showing the casing taken along line A—A of FIG. 7.
Figure 9:
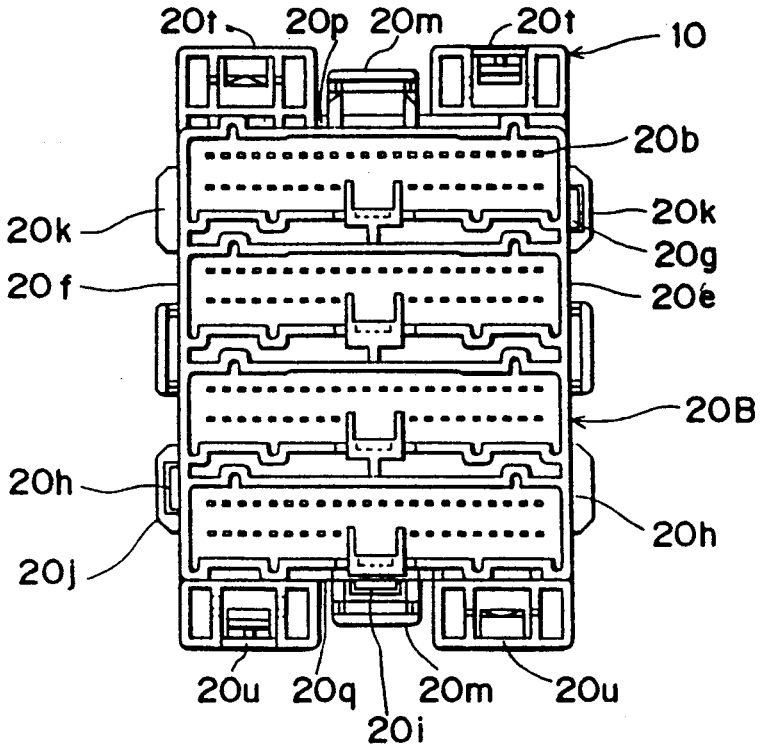
FIG. 9 is a rear view of the casing of FIG. 7.

Referring to FIGS. 7, 9, and 15, the mounting portions 20t and 20t of each of the upper and lower casings 20A and 20B are symmetrical with respect to the center point of the end face 20p of the casing member 20. Similarly, the mounting portions 20u and 20u of each of the upper and lower casing member 20A and 20B are symmetrical with respect to the center point of the end face 20q of the casing member 20.

As described above, the case 10 can be assembled by connecting the upper and lower casings 20A and 20B in the same configuration with each other. That is, the upper and lower casings 20A and 20B can be shaped in the same mold, which reduces manufacturing cost.

Referring to FIG. 16, the mounting portion 20t of the upper casing member 20A and that of lower casing member 20B are symmetrical with respect to the center point of the end face 20p of the casing member 20, and the mounting portion 20u of the upper casing member 20A and that of lower casing member 20B are symmetrical with respect to the center point of the end face 20q of the casing member 20. Therefore, the case 10 can be mounted on a bracket 50 of a car body by using the mounting portions 20t and 20u of the lower casing member 20B or those of the upper casing member 20A. Thus, the casing member 20 can be easily mounted on the bracket 50 without considering whether the case 10 is upward or downward.

Although the present invention has been fully described in connection with the preferred embodiments thereof with reference to the accompanying drawings, it is to be noted that various changes and modifications are apparent to those skilled in the art. Such changes and modification are to be understood as included within the scope of the present invention as defined by the appended claims unless they depart therefrom.

What is claimed is:

1. A connecting box, for forming a branch circuit, comprising two rectangular casing members, each being formed in the same configuration, and a plurality of conductive members; in which each casing member comprises:

a partitioning wall formed therein;

a plurality of connecting openings, each opening being formed in the same configuration, said plurality of connecting openings being disposed on one side of the partitioning wall;

a conductive member-accommodating portion disposed on the other side of the partitioning wall; and a plurality of connection portion-inserting openings formed on the partitioning wall;

wherein said two casing members are connected with each other to constitute a case having the conductive member-accommodating portion in a center portion thereof and the connecting openings front and back sides thereof;

said conductive members being disposed in the conductive member-accommodating portion so as to project a connecting portion of each conductive member into each of the connecting openings formed on the front and back sides of the case through each connection portion-inserting opening;

each conductive member being disposed in the conductive member-accommodating portion and comprising a plurality of terminals and single core wires;

each terminal comprising at least one blade which penetrates into a single core wire in a direction perpendicular to the axial direction of the single core wire and is brought into contact with the single core wire and the connecting portion, and extending symmetrically from the blade in a direction perpendicular to the axial direction of the single core wire; said connecting portion projecting into each of the connecting openings formed on the front and back sides of the case through each of the connection portion-inserting openings formed on both partitioning walls; and a plurality of said singe core wires being arranged in parallel with each other in the conductive member-accommodating portion so as to bring a plurality of terminals having connecting portions projecting into different connecting openings into contact with one of the single core wires.

2. A connecting box as defined in claim 1, wherein said terminal has four poles, each pole comprising a contact strip formed by extending connecting portions symmetrically in vertical and horizontal directions with respect to said at least one blade such that two contact strips functioning as poles project into the connecting openings formed in the front side and the back side of the case, respectively.

3. A connecting box, for forming a branch circuit, comprising two rectangular casing members, each being formed in the same configuration, and a plurality of conductive members; in which each casing member comprises:

a partitioning wall formed therein;

a plurality of connecting openings, each connector-connecting opening being formed in the same configuration, said plurality of connection openings being disposed on one side of the partitioning wall;

a conductive member-accommodating portion disposed on the other side of the partitioning wall; and a plurality of connection portion-inserting openings formed on the partitioning wall;

wherein said two casing members are connected with each other to constitute a case having the conductive member-accommodating portion in a center portion thereof and the connecting openings front and back sides thereof;

said conductive members being disposed in the conductive member-accommodating portion so as to project a connecting portion of each conductive member into each of the connecting openings formed on the front and back sides of the case through each connection portion-inserting opening;

wherein said conductive members disposed in the conductive member-accommodating portion comprise a vertical bus bar, in which tabs project at intervals from both sides of a center base plate of the vertical bus bar into respective connecting openings formed on front and back sides of the case through the connecting portion-inserting openings formed on both sides of the case.

4. A connecting box, for forming a branch circuit, comprising two rectangular casing members, each being formed in the same configuration, and a plurality of conductive members; in which each casing member comprises:

a partitioning wall formed therein;

a plurality of connecting openings, each connecting opening being formed in the same configuration, said plurality of connecting openings being disposed on one side of the partitioning wall;

a conductive member-accommodating portion disposed on the other side of the partitioning wall;

a plurality of connection portion-inserting openings formed on the partitioning wall;

wherein said two casing members are connected with each other to constitute a case having the conductive member-accommodating portion in a center portion thereof and the connecting openings front and back sides thereof;

said conductive members being disposed in the conductive member-accommodating portion so as to project a connecting portion of each conductive member into each of the connecting openings formed on the front and back sides of the case through each connection portion-inserting opening;

wherein the connecting openings are formed on one side of the casing member symmetrically in horizontal and vertical directions; the connection portion-inserting openings being formed on the partitioning wall symmetrically in horizontal and vertical directions; a male locking portion and a female locking portion being formed on one end face of the casing member; a male locking portion being formed on the other end face of the casing member and being opposed to the one end face such that both male locking portions are symmetrical with respect to a center point of the casing member, a female locking portion being formed on the other end face of the casing member opposed to the one end face such that both female locking portions are symmetrical with respect to the center point of the casing member;

one casing member being turned 180° with respect to the other casing member so that the male locking portions of the other casing member are locked by each female locking portion of the one casing member and the male locking portions of the one casing member are locked by each female locking portion of the other casing member, whereby both casing members are connected with each other.

5. A connecting box as defined in claim 4, wherein the connecting openings are formed on one side of a casing member symmetrically in horizontal and vertical directions; the connection portion-inserting openings being formed on a partitioning wall symmetrically in horizontal and vertical directions; a male locking portion and a female locking portion being formed on one end face of the casing member; a male locking portion being formed on the other end face thereof opposed to the one end face such that both male locking portions are symmetrical with respect to the center point of the casing member, and a female locking portion is formed on the other end face thereof opposed to the one end face such that both female locking portions are symmetrical with respect to the center point of the casing member;

one casing member being turned 180° vertically with respect to the other casing member so that the male locking portions of the other casing member are locked by each female locking portion of the one casing member and the male locking portions of the one casing member are locked by each female locking portion of the other casing member, whereby both casing members are connected with each other and the conductive members are accommodated in the conductive member-accommodating portion formed in the center portion of the case.

6. A connecting box as defined in claim 4, wherein mounting portions to be mounted on a car body are formed on end faces of each casing member, said mounting portions being opposed to each other and perpendicular to the end faces thereof on which the male and female locking portions are formed, such that the mounting portions on each end face of the case are symmetrical with respect to the center point thereof.

* * * * *

UNITED STATES PATENT AND TRADEMARK OFFICE

CERTIFICATE OF CORRECTION

PATENT NO. : 5,295,858
DATED : March 22, 1994
INVENTOR(S) : Kouji KASAI et al.

It is certified that error appears in the above-indentified patent and that said Letters Patent is hereby corrected as shown below:

Column 3, line 10, change "face" to ---face,---.

Column 5, line 28, change "configulation" to ---configuration---.

Column 5, line 38, change "casing the" to ---casing member 1a and the---.

Column 9, line 52 (claim 1, line 43), change "singe" to ---single---.

Signed and Sealed this

Fourth Day of April, 1995

Bruce Lehman

*Attest:*

BRUCE LEHMAN

*Attesting Officer*

*Commissioner of Patents and Trademarks*